US011004373B2

(12) United States Patent
Fang et al.

(10) Patent No.: US 11,004,373 B2
(45) Date of Patent: May 11, 2021

(54) SOURCE DRIVER AND OPERATING METHOD THEREOF

(71) Applicant: Novatek Microelectronics Corp., Hsinchu (TW)

(72) Inventors: Po-Hsiang Fang, Hsinchu (TW); Jhih-Siou Cheng, New Taipei (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 46 days.

(21) Appl. No.: 16/429,051

(22) Filed: Jun. 2, 2019

(65) Prior Publication Data

US 2020/0184869 A1 Jun. 11, 2020

Related U.S. Application Data

(60) Provisional application No. 62/776,407, filed on Dec. 6, 2018.

(51) Int. Cl.
*G09G 3/20* (2006.01)

(52) U.S. Cl.
CPC ..... *G09G 3/20* (2013.01); *G09G 2310/027* (2013.01); *G09G 2310/0289* (2013.01); *G09G 2310/08* (2013.01)

(58) Field of Classification Search
CPC ..... G09G 3/20; G09G 2310/0289; G09G 2310/027; G09G 2310/08; G09G 2330/06; G09G 2320/043; G09G 3/3275
See application file for complete search history.

(56) References Cited

U.S. PATENT DOCUMENTS

2011/0007067 A1* 1/2011 Ryu ..... G09G 3/3241 345/214
2011/0261084 A1* 10/2011 Tu ..... H03M 1/804 345/690
2014/0204071 A1* 7/2014 Kwon ..... G09G 3/3291 345/212
2016/0104428 A1* 4/2016 In ..... G09G 3/3291 345/214
2016/0351096 A1* 12/2016 Tani ..... G09G 3/3233
2018/0012543 A1* 1/2018 Lee ..... G09G 5/393

* cited by examiner

*Primary Examiner* — Amit Chatly
(74) *Attorney, Agent, or Firm* — JCIPRNET

(57) ABSTRACT

A source driver and an operating method thereof are provided. The source driver includes a high voltage circuit, a low voltage circuit and a sensing circuit. The low voltage circuit is coupled to the high voltage circuit. The high voltage circuit and low voltage circuit drive a display panel. The sensing circuit is coupled to the low voltage circuit. The sensing circuit senses the display panel during an analog-to-digital operating period. At least one of the high voltage circuit and the low voltage circuit is disabled during at least part of the analog-to-digital operating period.

18 Claims, 4 Drawing Sheets

SOURCE DRIVER AND OPERATING METHOD THEREOF

CROSS-REFERENCE TO RELATED APPLICATION

This application claims the priority benefit of U.S. provisional application Ser. No. 62/776,407, filed on Dec. 6, 2018. The entirety of the above-mentioned patent application is hereby incorporated by reference herein and made a part of this specification.

BACKGROUND

Technical Field

The disclosure relates to a display driver, and particularly relates to a source driver and an operating method thereof.

Description of Related Art

In general, owing to the aging problem of the display panel, the product life of the electronic product having the display panel is limited by the aging speed of the display panel. In particular, when the display panel has only a slight brightness decay, other electronic units in the electronic product can still work normally. Therefore, in order to maintain the display quality to extend the product life of the electronic product, monitoring the panel state of the display panel to provide corresponding drive compensation during the operation of the display panel is one of the main solutions at present. However, how to accurately monitor the panel state of the display panel has not been effectively solved. In view of this, how to efficiently and accurately monitor the display panel, the solutions of several embodiments are provided below.

SUMMARY

The disclosure is directed to a source driver and an operating method thereof that are capable of effectively reducing noise interference generated by some circuit units inside the source driver when the source driver is sensing the display panel.

The source driver of the disclosure includes a high voltage circuit, a low voltage circuit and a sensing circuit. The low voltage circuit is coupled to the high voltage circuit. The high voltage circuit and low voltage circuit are configured to drive a display panel. The sensing circuit is coupled to the low voltage circuit. The sensing circuit is configured to sense the display panel during an analog-to-digital operating period. At least one of the high voltage circuit and the low voltage circuit is disabled during at least part of the analog-to-digital operating period.

In an embodiment of the disclosure, the analog-to-digital operating period includes a sampling period and a data conversion period. The at least one of the low voltage circuit and the high voltage circuit is disabled during at least one of the sampling period and the data conversion period.

In an embodiment of the disclosure, the sensing circuit includes a sample circuit. The sample circuit coupled to the display panel. The sample circuit is configured to sample the display panel to receive a plurality of sample signals from the display panel during the sampling period.

In an embodiment of the disclosure, the sensing circuit further includes an analog-to-digital converter circuit. The analog-to-digital converter circuit is coupled to the display pane. The analog-to-digital converter circuit is configured to convert a sample result from the display panel during the data conversion period.

In an embodiment of the disclosure, the low voltage circuit includes a receiving circuit and a latch circuit. The receiving circuit is coupled to the sensing circuit. The latch circuit is coupled to the receiving circuit and the high voltage circuit. The receiving circuit outputs a first toggle signal to the latch circuit to toggle the latch circuit, and the receiving circuit masks the first toggle signal during the at least part of the analog-to-digital operating period to disable the latch circuit.

In an embodiment of the disclosure, the receiving circuit is disabled simultaneously during the at least part of the analog-to-digital operating period.

In an embodiment of the disclosure, the high voltage circuit includes a level shifter circuit and an operational amplifier circuit. The operational amplifier circuit is coupled to the level shifter circuit. The level shifter circuit outputs a second toggle signal to the high voltage circuit according to a first toggle signal, and the second toggle signal is masked during the at least part of the analog-to-digital operating period to disable the operational amplifier circuit.

In an embodiment of the disclosure, the receiving circuit simultaneously disables the level shifter circuit during the at least part of the analog-to-digital operating period.

In an embodiment of the disclosure, the high voltage circuit further includes a digital-to-analog converter circuit. The digital-to-analog converter circuit is coupled to the latch circuit and the operational amplifier circuit. The digital-to-analog converter circuit is simultaneously disabled during the at least part of the analog-to-digital operating period.

The operating method of the disclosure includes steps of: toggling a low voltage circuit and a high voltage circuit to drive a display panel; operating a sensing circuit to sense the display panel during an analog-to-digital operating period; and disabling at least one of the low voltage circuit and the high voltage circuit during at least part of the analog-to-digital operating period.

In an embodiment of the disclosure, the analog-to-digital operating period includes a sampling period and a data conversion period. The step of disabling the at least one of the low voltage circuit and the high voltage circuit during the at least part of the analog-to-digital operating period comprises: disabling the at least one of the low voltage circuit and the high voltage circuit during at least one of the sampling period and the data conversion period.

In an embodiment of the disclosure, the sensing circuit includes a sample circuit. The sample circuit is configured to sample the display panel to receive a plurality of sample signals from the display panel during the sampling period.

In an embodiment of the disclosure, the sensing circuit includes an analog-to-digital converter circuit. The analog-to-digital converter circuit is configured to convert a sample result from the display panel during the data conversion period.

In an embodiment of the disclosure, the low voltage circuit includes a receiving circuit and a latch circuit. The receiving circuit outputs a first toggle signal to the latch circuit to toggle the latch circuit. The step of disabling the at least one of the low voltage circuit and the high voltage circuit during the at least part of the analog-to-digital operating period comprises: masking the first toggle signal during the at least part of the analog-to-digital operating period to disable the latch circuit.

In an embodiment of the disclosure, the step of disabling the at least one of the low voltage circuit and the high voltage circuit during the at least part of the analog-to-digital operating period further comprises: simultaneously disabling the receiving circuit during the at least part of the analog-to-digital operating period.

In an embodiment of the disclosure, the high voltage circuit comprises a level shifter circuit and an operational amplifier circuit. The level shifter circuit outputs a second toggle signal to the high voltage circuit according to a first toggle signal. The step of disabling the at least one of the low voltage circuit and the high voltage circuit during the at least part of the analog-to-digital operating period includes: masking the second toggle signal during the at least part of the analog-to-digital operating period to disable the operational amplifier circuit.

In an embodiment of the disclosure, the step of disabling the at least one of the low voltage circuit and the high voltage circuit during the at least part of the analog-to-digital operating period further comprises: simultaneously disabling the level shifter circuit during the at least part of the analog-to-digital operating period.

In an embodiment of the disclosure, the high voltage circuit further comprises a digital-to-analog converter circuit. The step of disabling the at least one of the low voltage circuit and the high voltage circuit during the at least part of the analog-to-digital operating period further comprises: simultaneously disabling the digital-to-analog converter circuit during the at least part of the analog-to-digital operating period.

Based on the above, the source driver and the operating method of the disclosure can effectively reduce noise interference generated by some circuit units inside the source driver to provide effective and accurate panel sensing results.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

It is to be understood that other embodiments may be utilized and structural changes may be made without departing from the scope of the disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
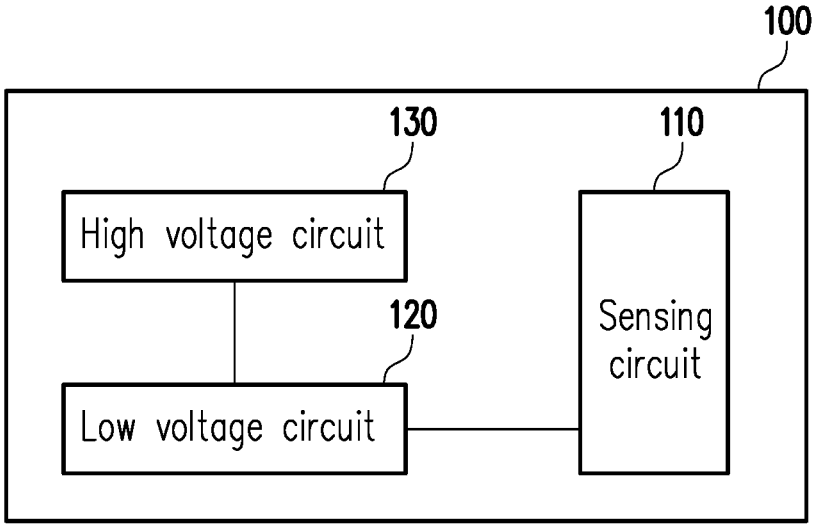
FIG. 1 is a block diagram illustrating a source driver according to an embodiment of the disclosure.

FIG. 1 is a block diagram illustrating a source driver according to an embodiment of the disclosure. Referring to FIG. 1, a source driver 100 includes a sensing circuit 110, a low voltage circuit 120 and a high voltage circuit 130. The sensing circuit 110 is coupled to the low voltage circuit 120, and the low voltage circuit 120 is coupled to the high voltage circuit 130. In the embodiment, the source driver 100 is a driver chip, and the low voltage circuit 120 and the high voltage circuit 130 of the source driver 100 may be used to drive an organic light-emitting diode (OLED) display panel or light-emitting diode (LED) display panel, etc., but the disclosure is not limited thereto. In the embodiment, the source driver 100 may be coupled to a display panel and a timing controller (TCON).

For example, due to a plurality of pixel units in the organic light-emitting diode display panel may have panel aging problem, such as brightness attenuation which is resulted by the repeating displaying operations, the source driver 100 of the embodiment may operates the sensing circuit 110 by sensing a voltage or current to sense the brightness of the pixel units of the display panel or other panel status, so that the source driver 100 may adjust the driving signal of display panel by performing a voltage or current compensation. Therefore, in the embodiment, the sensing circuit 110 is used to sense or sample the pixel units in the display panel to obtain a plurality of analog sample signals, and the sensing circuit 110 converts an analog sample data corresponding to the analog sample signals to a digital sample data. Further, the sensing circuit 110 may further output the digital sample data to the timing controller, so that the timing controller may compensate the display panel based on the digital sample data.

In the embodiment, the source driver 100 is a high voltage and low voltage hybrid circuit. The low voltage circuit 120 and the high voltage circuit 130 are used to drive the pixel units of the display panel. In the embodiment, the low voltage circuit 120 may include a low voltage analog circuit, a receiving circuit, a transmitter circuit or a logic circuit, etc., but the disclosure is not limited thereto. The high voltage circuit 130 may include an operational amplifier circuit, a digital-to-analog converter circuit, a chopper circuit or a level shifter circuit, etc., but the disclosure is also not limited thereto. In the embodiment, the sensing circuit 110 may include an analog-to-digital converter circuit for converting the sensing result about the display panel, and the analog-to-digital converter circuit may be very sensitive to noise. However, while the low voltage circuit 120 or the high voltage circuit 130 is being operated, the low voltage circuit 120 or the high voltage circuit 130 may generate a low voltage noise or a high voltage noise to interfere the sensing result of the sensing circuit 110, especially during an analog-to-digital operating period of the sensing circuit 110. Therefore, in the embodiment, at least one of the low voltage circuit 120 and the high voltage circuit 130 is disabled during at least part of the analog-to-digital operating period of the sensing circuit 110 to effectively reduce noise interference.

Figure 2:
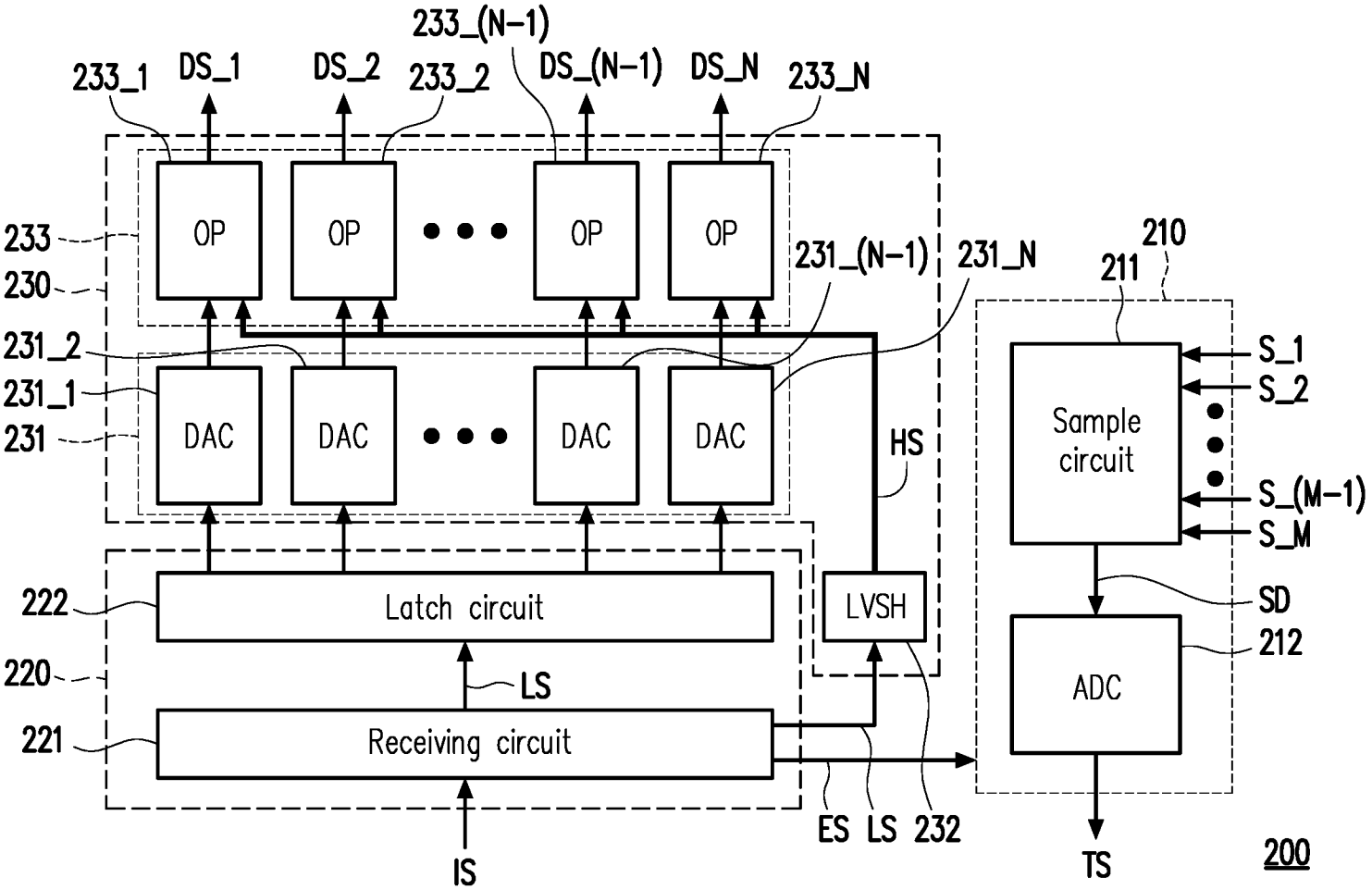
FIG. 2 is a block diagram illustrating a source driver according to another embodiment of the disclosure.

FIG. 2 is a block diagram illustrating a source driver according to another embodiment of the disclosure. Referring to FIG. 2, a source driver 200 includes a sensing circuit 210, a low voltage circuit 220 and a high voltage circuit 230. The sensing circuit 210 is coupled to the low voltage circuit 220, and the low voltage circuit 220 is coupled to the high voltage circuit 230. In the embodiment, the sensing circuit 210 includes a sample circuit 211 and an analog-to-digital converter circuit (ADC) 212. The sample circuit 211 may, for example, include a plurality of sample-and-hold circuit and a plurality of sensing channels, and the sample circuit 211 may receive a plurality of analog sample signals S_1-S_M by the sensing channels from a display panel, but the disclosure is not limited thereto. M is a positive integer greater than 1. In some embodiments, the analog-to-digital converter circuit 212 may include a plurality of analog-to-digital converter. That is, the sample circuit 211 transmits an analog sample data SD corresponding to the analog sample signals S_1-S_M to the analog-to-digital converter circuit 212, and the analog-to-digital converter circuit 212 converts the analog sample data SD into digital data regarding panel information and output an output signal TS including the digital data to a timing controller, so that the timing controller may perform related compensation operations for display driving based on the output signal TS. In some embodiments, the sensing circuit 210 may further include other circuit, such as a latch circuit or a parallel to serial (P2S) circuit, etc., which is not limited by the disclosure.

In the embodiment, the low voltage circuit 220 includes a receiving circuit 221 and a latch circuit 222, the receiving circuit 221 and the latch circuit 222 are operated by a low voltage level. The receiving circuit 221 is coupled to the sensing circuit 210 and the latch circuit 222, and may couple to the timing controller to receive an input signal IS from the timing controller. The input signal IS may include a variety of signal, such as clock signal, control signal or image signal, etc., which is not limited by the disclosure. The receiving circuit 221 may output a first toggle signal LS to the latch circuit 222 to toggle (or to enable) the latch circuit 222, or may output an enable signal ES to the sensing circuit 210 to ask the sensing circuit 210 to start the above sensing operations. It should be noted that, the first toggle signal LS may be a low voltage, and be used to toggle some low voltage circuit units, thereby enabling the low voltage circuit units. In some embodiments, the low voltage circuit 220 may further include other circuit, such as a low voltage analog circuit, a transmitter circuit or a logic circuit, etc., which is not limited by the disclosure.

In the embodiment, the high voltage circuit 230 includes a digital-to-analog converter circuit 231, a level shifter circuit (LVSH) 232 and an operational amplifier circuit 233. The digital-to-analog converter circuit 231 is coupled to the latch circuit 222, and receives the digital data from the latch circuit 222. In the embodiment, the digital-to-analog converter circuit 231 includes a plurality of digital-to-analog converters (DAC) 231_1-231_N, and the operational amplifier circuit 233 includes a plurality of operational amplifiers (OP) 233_1-233_N. N is a positive integer greater than 1. The digital-to-analog converters 231_1-231_N convert the digital data into analog data, and output the analog data to the operational amplifiers 233_1-233_N. Hence, the operational amplifiers 233_1-233_N may output a plurality of driving signals DS_1-DS_N to the pixel units of the display panel according to the analog data.

In the embodiment, the level shifter circuit 232 is coupled to the operational amplifier circuit 233. The receiving circuit 221 may further output the first toggle signal LS to the level shifter circuit 232, and the level shifter circuit 232 converts the first toggle signal LS having a low voltage level to a second toggle signal HS having a high voltage level. The level shifter circuit 232 outputs the second toggle signal HS to the operational amplifiers 233_1-233_N to toggle (or to enable) the operational amplifiers 233_1-233_N. It should be noted that, the second toggle signal HS may be a high voltage, and be used to toggle some high voltage circuit units, thereby enabling the high voltage circuit units. Moreover, in some embodiments, the latch circuit 222 may further provide a plurality of toggle signal having the low voltage level to another plurality of level shifters, so as to correspondingly output another plurality of toggle signals having the high voltage level to each of the digital-to-analog converters 231_1-231_N.

More specifically, during a driving period, the receiving circuit 221 may receive the input signal IS having some panel driving data from the timing controller, and output the first toggle signal LS to the latch circuit 222 and the level shifter circuit 232 to enable the latch circuit 222 based on the input signal IS. Then, the level shifter circuit 232 output the second toggle signal HS to the operational amplifiers 233_1-233_N, and the digital-to-analog converters 231_1-231_N are enabled at the same time. However, when the receiving circuit 221 receives the input signal IS having some sensing request instruction from the timing controller, the receiving circuit 221 outputs the enable signal ES to the sensing circuit 210 based on the input signal IS, so as to ask the sensing circuit 210 to start the above sensing operations. In the embodiment, the sample operation of the sample circuit 211 and the conversion operation of the analog-to-digital converter circuit 212 may both be very sensitive to noise, so at least one of the low voltage circuit 220 and the high voltage circuit 230 is simultaneously disabled during the sample period and the conversion period. Therefore, at least one of the sample circuit 211 and the analog-to-digital converter circuit 212 may reduce the noise interference from the at least one of the low voltage circuit 220 and the high voltage circuit 230 during an analog-to-digital operating period, where the analog-to-digital operating period includes the sample period and the conversion period.

Figure 3:
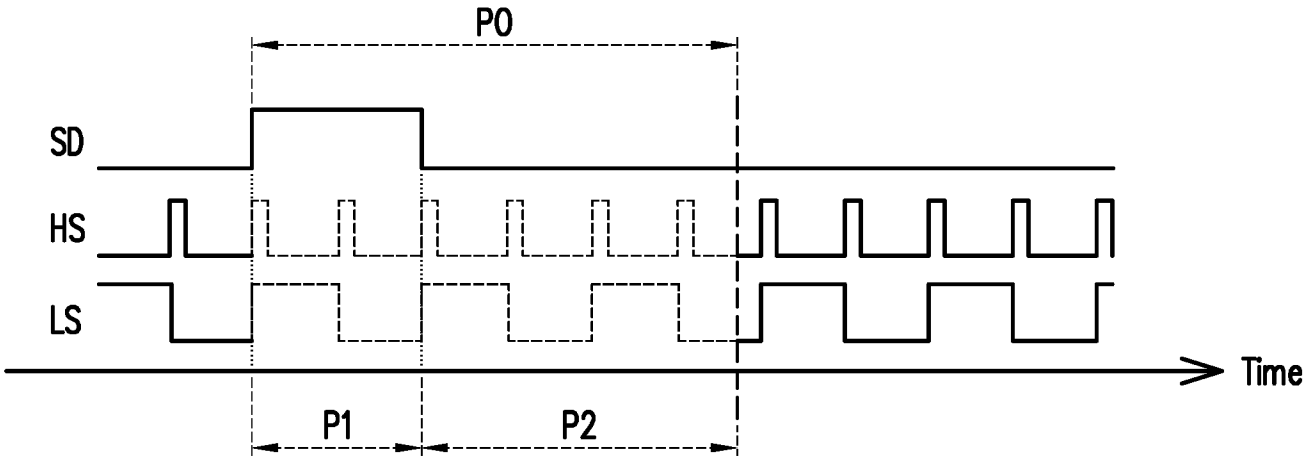
FIG. 3 is a signal timing diagram of a first toggle signal and a second toggle signal according to an embodiment of the disclosure.

FIG. 3 is a signal timing diagram of a first toggle signal and a second toggle signal according to an embodiment of the disclosure. Referring to FIG. 2 and FIG. 3, to be more particularly, when the sensing circuit 210 is sensing the display panel during the analog-to-digital operating period P0, the receiving circuit 221 may simultaneously mask the first toggle signal LS and the second toggle signal HS as shown in FIG. 3. It should be noted that, in some embodiments, the receiving circuit 221 may operate a switch circuit to disable or uncouple the first toggle signal LS and the second toggle signal HS to the low voltage circuit 220 and the high voltage circuit 230, or mask the first toggle signal LS and the second toggle signal HS by other signal control methods. Thus, during an analog-to-digital operating period P0, the latch circuit 222, the level shifter circuit 232 and the operational amplifier circuit 233 are disabled at the same time, and the digital-to-analog converter circuit 231 may be simultaneously disabled by the receiving circuit 221. However, the signal timing diagram of the present disclosure about masking the trigger signals is not limited to the FIG. 3. In one embodiment, the source driver 200 may disable the high voltage circuit and the low voltage circuit during at least part of the analog-to-digital operating period P0.

Furthermore, the analog-to-digital operating period P0 includes a sampling period P1 and a data conversion period P2. During the sampling period P1, the sample circuit 211 receives the sample signals S_1-S_M from the display panel and transmits the analog sample data corresponding to the sample signals S_1-S_M to the analog-to-digital converter circuit 212. During the data conversion period P2, the sample circuit 211 is stop to receive the sample signals S_1-S_M from the display panel, and the analog-to-digital converter circuit 212 converts the analog sample data SD and outputs the output signal TS to the timing controller.

That is, in some embodiments, the source driver 200 may disable the low voltage circuit 220 and the high voltage circuit 230 only during the sampling period P1 or during the data conversion period P2. Moreover, in another some embodiments, the source driver 200 may only disable the low voltage circuit 220 or the high voltage circuit 230 only during the sampling period P1 or during the data conversion period P2.

Figure 4:
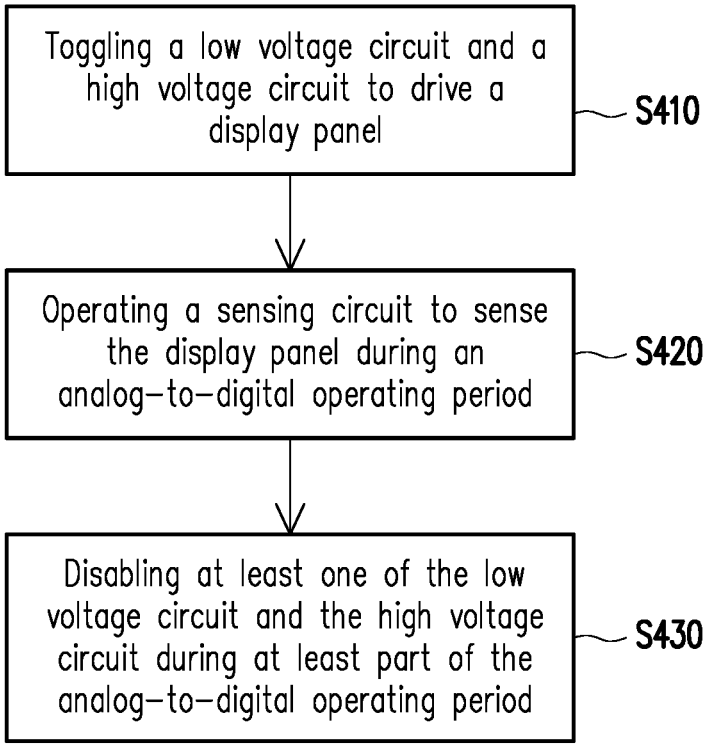
FIG. 4 is a flowchart of an operating method according to an embodiment of the disclosure.

FIG. 4 is a flowchart of an operating method according to an embodiment of the disclosure. Referring to FIG. 1 and FIG. 4 the operating method of this embodiment may at least be adapted to the source driver 100 in the embodiment of FIG. 1. The source driver 100 can execute steps S410 to S430. In step S410, the source driver 100 toggles the low voltage circuit 120 and the high voltage circuit 130 and to drive the display panel. In step S420, the source driver 100 operates the sensing circuit 110 to sense the display panel during an analog-to-digital operating period. In step S430, the source driver 100 disables at least one of the low voltage circuit 120 and the high voltage circuit 130 during at least part of the analog-to-digital operating period. Therefore, the source driver 100 executing the operating method can effectively reduce the sensing result of the sensing circuit 110 suffer the noise interference from the at least one of the low voltage circuit 120 and the high voltage circuit 130 during the at least part of the analog-to-digital operating period.

In addition, enough teaching, suggestion, and implementation regarding related device features, implementation methods and technical details of the source driver 100 of this embodiment may be obtained with reference to the foregoing embodiments of FIG. 1 to FIG. 3, which are not repeated hereinafter.

In summary, the source driver and the operating method of the disclosure can effectively reduce noise interference by disabling at least one of the high voltage circuit and the low voltage circuit during the at least part of the analog-to-digital operating period, so that the source driver and the operating method of the disclosure can provide effective and accurate panel sensing results.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A source driver, comprising: a high voltage circuit; a low voltage circuit, coupled to the high voltage circuit, wherein the high voltage circuit and low voltage circuit are configured to drive a display panel; and a sensing circuit, coupled to the low voltage circuit, and configured to sense the display panel during an analog-to-digital operating period, wherein at least one of the high voltage circuit and the low voltage circuit is disabled during at least part of the analog-to-digital operating period; and wherein the source driver masks at least one of a first toggle signal having a low voltage level for enabling the low voltage circuit and a second toggle signal having a high voltage level for enabling the high voltage circuit to disable the at least one of the high voltage circuit and the low voltage circuit.

2. The source driver as claimed in claim 1, wherein the analog-to-digital operating period comprises a sampling period and a data conversion period, and the at least one of the low voltage circuit and the high voltage circuit is disabled during at least one of the sampling period and the data conversion period.

3. The source driver as claimed in claim 2, wherein the sensing circuit comprises:

a sample circuit, coupled to the display panel, and configured to sample the display panel to receive a plurality of sample signals from the display panel during the sampling period.

4. The source driver as claimed in claim 2, wherein the sensing circuit further comprises:

an analog-to-digital converter circuit, coupled to the display panel, and configured to convert a sample result from the display panel during the data conversion period.

5. The source driver as claimed in claim 1, wherein the low voltage circuit comprises:

a receiving circuit, coupled to the sensing circuit; and a latch circuit, coupled to the receiving circuit and the high voltage circuit, wherein the receiving circuit outputs a first toggle signal to the latch circuit to toggle the latch circuit, and the receiving circuit masks the first toggle signal during the at least part of the analog-to-digital operating period to disable the latch circuit.

6. The source driver as claimed in claim 5, wherein the receiving circuit is disabled simultaneously during the at least part of the analog-to-digital operating period.

7. The source driver as claimed in claim 1, wherein the high voltage circuit comprises:

a level shifter circuit; and an operational amplifier circuit, coupled to the level shifter circuit, wherein the level shifter circuit outputs a second toggle signal to the high voltage circuit according to a first toggle signal, and the second toggle signal is masked during the at least part of the analog-to-digital operating period to disable the operational amplifier circuit.

8. The source driver as claimed in claim 7, wherein the receiving circuit simultaneously disables the level shifter circuit during the at least part of the analog-to-digital operating period.

9. The source driver as claimed in claim 7, wherein the high voltage circuit further comprises:

a digital-to-analog converter circuit, coupled to the latch circuit and the operational amplifier circuit, wherein the digital-to-analog converter circuit is simultaneously disabled during the at least part of the analog-to-digital operating period.

10. An operating method of a source driver, comprising: toggling a low voltage circuit and a high voltage circuit to drive a display panel; operating a sensing circuit to sense the display panel during an analog-to-digital operating period; and disabling at least one of the low voltage circuit and the high voltage circuit during at least part of the analog-to-digital operating period; and masking at least one of a first toggle signal having a low voltage level for enabling the low voltage circuit and a second toggle signal having a high voltage level for enabling the high voltage circuit to disable the at least one of the high voltage circuit and the low voltage circuit.

11. The operating method as claimed in claim 10, wherein the analog-to-digital operating period comprises a sampling period and a data conversion period, and the step of disabling the at least one of the low voltage circuit and the high voltage circuit during the at least part of the analog-to-digital operating period comprises:

disabling the at least one of the low voltage circuit and the high voltage circuit during at least one of the sampling period and the data conversion period.

12. The operating method as claimed in claim 11, wherein the sensing circuit comprises a sample circuit, and the sample circuit is configured to sample the display panel to receive a plurality of sample signals from the display panel during the sampling period.

13. The operating method as claimed in claim 11, wherein the sensing circuit comprises an analog-to-digital converter circuit, and the analog-to-digital converter circuit is configured to convert a sample result from the display panel during the data conversion period.

14. The operating method as claimed in claim 10, wherein the low voltage circuit comprises a receiving circuit and a latch circuit, and the receiving circuit outputs the first toggle signal to the latch circuit to toggle the latch circuit, wherein the step of disabling the at least one of the low voltage circuit and the high voltage circuit during the at least part of the analog-to-digital operating period comprises:

masking the first toggle signal during the at least part of the analog-to-digital operating period to disable the latch circuit.

15. The operating method as claimed in claim 14, wherein the step of disabling the at least one of the low voltage circuit and the high voltage circuit during the at least part of the analog-to-digital operating period further comprises:

simultaneously disabling the receiving circuit during the at least part of the analog-to-digital operating period.

16. The operating method as claimed in claim 10, wherein the high voltage circuit comprises a level shifter circuit and an operational amplifier circuit, and the level shifter circuit outputs a second toggle signal to the high voltage circuit according to a first toggle signal, wherein the step of disabling the at least one of the low voltage circuit and the high voltage circuit during the at least part of the analog-to-digital operating period comprises:

masking the second toggle signal during the at least part of the analog-to-digital operating period to disable the operational amplifier circuit.

17. The operating method as claimed in claim 16, wherein the step of disabling the at least one of the low voltage circuit and the high voltage circuit during the at least part of the analog-to-digital operating period further comprises:

simultaneously disabling the level shifter circuit during the at least part of the analog-to-digital operating period.

18. The operating method as claimed in claim 16, wherein the high voltage circuit further comprises a digital-to-analog converter circuit, and the step of disabling the at least one of the low voltage circuit and the high voltage circuit during the at least part of the analog-to-digital operating period further comprises:

simultaneously disabling the digital-to-analog converter circuit during the at least part of the analog-to-digital operating period.

* * * * *